US006571409B2

(12) United States Patent
Guillot

(10) Patent No.: US 6,571,409 B2
(45) Date of Patent: Jun. 3, 2003

(54) CRIB HARDWARE

(75) Inventor: Edmond P. Guillot, Toccoa, GA (US)

(73) Assignee: Gem Industries, Inc., Toccoa, GA (US)

( * ) Notice: Subject to any disclaimer, the term of this patent is extended or adjusted under 35 U.S.C. 154(b) by 0 days.

(21) Appl. No.: 10/118,561

(22) Filed: Apr. 9, 2002

(65) Prior Publication Data

US 2002/0157181 A1 Oct. 31, 2002

Related U.S. Application Data

(63) Continuation of application No. 09/288,150, filed on Apr. 8, 1999, now abandoned.

(51) Int. Cl.[7] ..... A47D 7/02
(52) U.S. Cl. ..... 5/100; 5/93.1
(58) Field of Search ..... 5/100, 93.1, 424, 5/428, 430; 292/132, 136, DIG. 4

(56) References Cited

U.S. PATENT DOCUMENTS 1,695,571 A * 12/1928 Baxter ..... 5/100
2,369,834 A * 2/1945 Lundin ..... 5/100
5,165,124 A * 11/1992 Li ..... 292/DIG. 4
5,617,593 A * 4/1997 Pham ..... 5/100

* cited by examiner

*Primary Examiner*—Teri Pham Luu
*Assistant Examiner*—Fredrick Conley
(74) *Attorney, Agent, or Firm*—Robert R. Strack

(57) ABSTRACT

Concealed hardware for controlling the raising and lowering of the crib side, permits the construction of a crib which includes no projecting or exposed parts. The hardware comprises a channel member embedded within the end stiles of the crib side and an engaged coupling element fastened to the adjacent crib end. The channel member restricts movement of the crib side to vertical translation, and includes a latching chamber at the bottom which selectively traps or releases the coupling element when it is desired to secure the crib side in an elevated position.

9 Claims, 2 Drawing Sheets

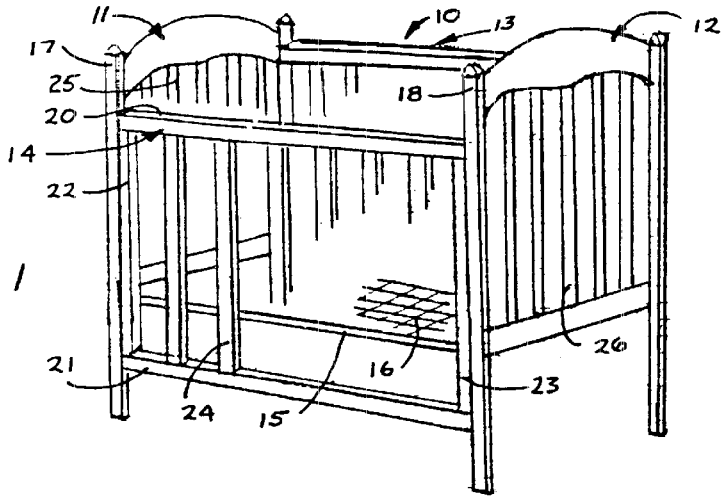
FIG. 1
FIG. 2
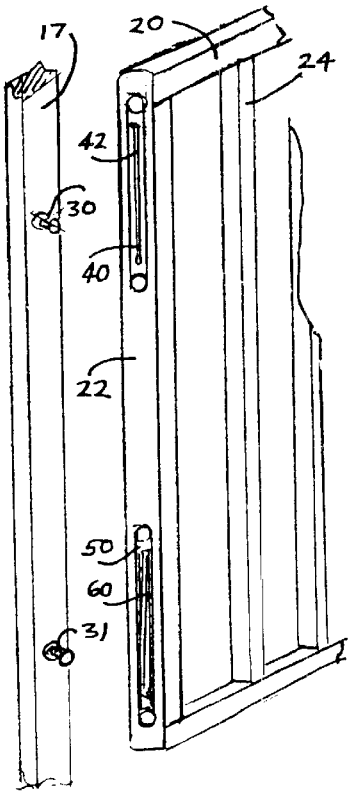
FIG. 3
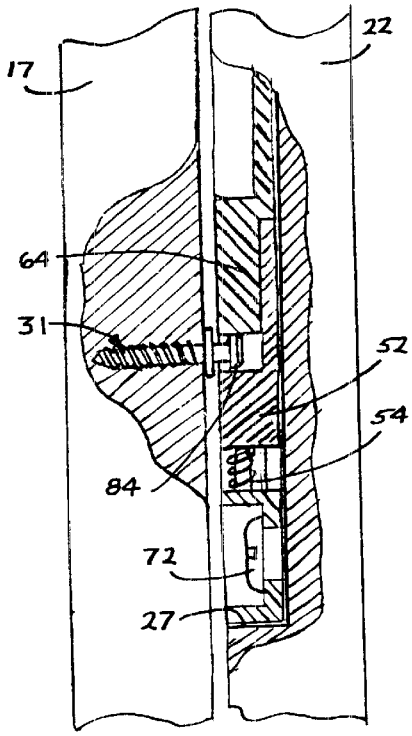
FIG. 12
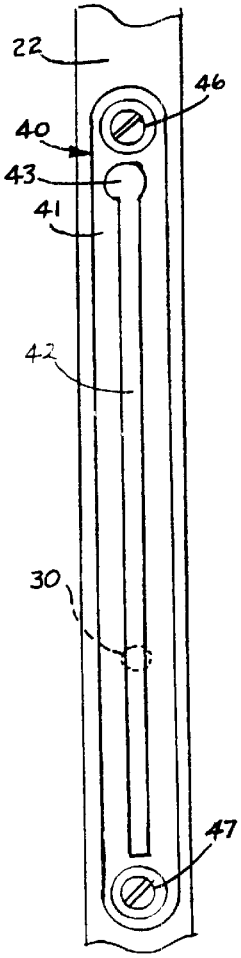

CRIB HARDWARE

This application is a continuation of application Ser. No. 09/288,150 filed Apr. 8, 1999.

BACKGROUND OF THE INVENTION a) Field of the Invention

The present invention relates to a child's crib having a releasable side that can be raised and lowered at will. More particularly, it relates to such a crib wherein the hardware that secures and controls the movement of the releasable side is completely concealed and inaccessible whether the side is in a raised or lowered position.

(b) Description of Related Art

For convenience and ease of use, most child's cribs are provided with at least one side that can be lowered for better access to the child. While movement of the side changes the structure of the crib, it must be effected without weakening the rigidity of the crib assembly. By regulation and practice, it is now recognized that the mechanism for latching and locking movable crib sides, should engage automatically and should require two separate positive and simultaneous actions to release the locking mechanism that holds the side in a raised position.

Perhaps the most common crib hardware for a releasable side, is a vertical rod mounted parallel to each crib end post and extending through grommets in the top and bottom rails of the side. A latching bar is provided along the bottom rail, which projects into and engages stationary catch elements on the surface of the end posts. The latching bar is spring biased and the catch elements are configured so that simultaneous turning of the bar and a slight lifting of the side, is required to release the latch and permit lowering of the side.

The presence of exposed hardware is objectionable in crib structures. Aside from being aesthetical disturbing, children find hardware a curiosity that demands investigation, touching and tasting. Exposed hardware projections act to catch children's garments and crib bedding, and at worst, raise the risk of laceration. Exposed hardware cavities create the threat of having a child's tiny fingers pinched as the side is raised or lowered.

There are many crib designs that attempt to minimize the exposure of babies to the potential attractions and dangers of crib hardware. For example, the gap between the ends of a releasable crib side and ends of the crib has been reduced by the simple expedient of providing posts at the ends of the side, with mounting hardware coupling the posts to the adjacent crib ends. U.S. Pat. No. 4,811,436, to Schwartz, illustrates a design with slotted end posts providing a guide path for spring biased locking pins in the side posts. U.S. Pat. No. 5,617,593, to Pham, shows a pin guiding track embedded in the end posts which engage a spring loaded pin mounted in the side post. Until the present invention, there has been no successful design that completely concealed the crib hardware whether the side was in its raised or lowered position.

SUMMARY OF THE INVENTION

It is a primary object of the present invention to provide a safe and secure child's crib.

Another important object of the present invention to provide a child's crib with an improved latching mechanism for a releasable side.

Still another object of the present invention is to provide improved latching hardware and guide means for a crib side that remain concealed whether the side is raised or lowered.

The present invention features a child's crib with a releasable side, that contains no exposed hardware for effecting the mounting, latching, or movement of the side.

The present invention also features unique latching and guide hardware adapted for mounting within the end posts of a crib side, to the support the crib ends while latching and guiding transitional movements of the crib side.

According to the invention, there is provided a child's crib having a releasable side interposed between crib ends; coupling elements bridge each side and the adjacent end, at the upper and lower sections of each side; the spacing between the coupling elements being less than the height of the side; latching and guide elements are mounted within and below the surface of the side end posts engaging respective coupling elements; whereby the coupling elements are always within the transit path of the side and the latching and guide elements are concealed in proximity to the end posts at all times.

According to another aspect of the invention, there is provided latching hardware for a releasable side crib including a guide element, a latching/guide mechanism, and several coupling elements; the upper guide element having an elongated slot for engagement with one of the coupling elements; the latching/guide mechanism having an elongated slot for guiding the other coupling element, said slot terminating in a latching cavity with biasing means that releasably retain the associated coupling element; both the guide element and the latching/guide mechanism being adapted for mounting below the surface of an end post of the crib side.

DESCRIPTION OF THE DRAWINGS

A particular embodiment of the invention is described in connection with the drawings, wherein:

FIG. 1 is a perspective view of a child's crib embodying the features of the present invention;

FIG. 2 is an enlarged and reoriented view of the crib end post adjacent to the end of a detached releasable crib side;

FIG. 3 is a still more enlarged view of the crib end post in proximity to the adjacent crib side, broken away to illustrate engagement between a coupling element and the latching/guide mechanism of the invention;

FIG. 12 is an end view of the upper edge of the crib side, showing the mounted guide element that controls vertical movement of the top of the crib side and couples the side to the adjacent crib end.

DETAILED DESCRIPTION OF THE INVENTION

Figure 4:
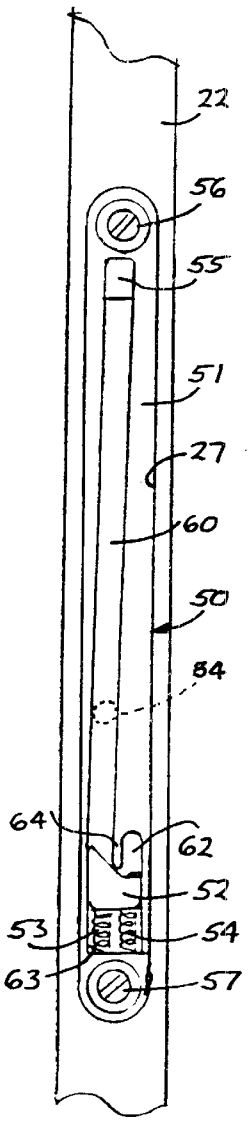
FIG. 4 is an end view of the lower edge of the crib side, showing the mounted latching/guide mechanism that controls raising, lowering and locking of the crib side.

FIG. 1 illustrates a child's crib 10, comprising the features of a preferred embodiment of the invention. It includes end units 11, 12, and side units 13, 14. Although both sides may be releasably mounted for raising and lowering, for purposes of the current description, only releasable crib side 14 will be described.

The crib structure includes a stabilizing bar or rail 15 rigidly interconnecting the lower portion of ends 11, 12. This bar might also optionally support a typical mattress spring 16. A similar bar might be provided on the other side of the crib.

Releasable crib side 14 comprises upper and lower horizontal rails 20, 21, respectively, interconnecting vertical side posts 22, 23 and, typically, a plurality of spaced elements 24 which permit visibility through the side and insure safety of the crib's occupant. Similar vertically spaced elements 25, 26 are shown in ends 11, 12; however, it will be appreciated that the use of such elements is not germane to the invention.

Side posts 22, 23 are adjacent to the proximate ends of crib 10. It will be noted that there is no visible hardware on the crib ends 11, 12 or between the side posts 22, 23 and the ends. This characteristic feature is made possible by the unique crib design and crib hardware of the present invention.

FIG. 2 illustrates an end post 17 of the type typically supporting and forming part of crib end 11. Structurally, though not necessary, end post 17 may be on of the legs of crib 10. End post 17 is shown adjacent to, and separate from, crib side 14, to which it will be attached in the final crib structure. Spaced longitudinally along end post 17, are first and second coupling elements 30, 31. These coupling elements serve distinct functions and will be described more completely hereinafter. In the illustrated embodiment they are of similar configuration, acting as both fasteners and followers; however, it will be obvious to those skilled in the art, that distinct configurations may be selected to cooperate effectively with the specific design chosen to implement the functions and features of the related guide element or latching guide mechanism.

Mounted within the face surface of side post 22 of crib side 14, there is a guide element 40 and a latching/guide mechanism 50. When assembled, as illustrated in FIG. 1, upper coupling element 30 is engaged in the track 42 of guide element 40, and lower coupling element 31 is nested within the channel 60 of latching/guide mechanism 50.

FIG. 3 is an enlarged view of end post 17 when engaged with side post 22 by means of coupling element 31 and latching/guide mechanism 50. In the position shown, the head 84 of coupling element 31 is trapped between a resiliently biased follower 52 and a dividing partition 64 within latching/guide mechanism 50. The interaction between coupling element 31 and latching/guide mechanism 50 will be understood by consideration of the structure of the latching/guide mechanism as illustrated in FIGS. 4 through 10.

FIG. 4 shows latching/guide mechanism 50 mounted within a cavity 27 in side post 22. The depth of the latching/guide mechanism 50 and that of cavity 27, are substantially the same so that the surface of the mechanism housing 51, is flush with the surface of side post 22. Latching/guide mechanism 50 is held in position with fasteners 56, 57 which are countersunk to insure that they too are beneath the surface of side post 22.

Figure 5:
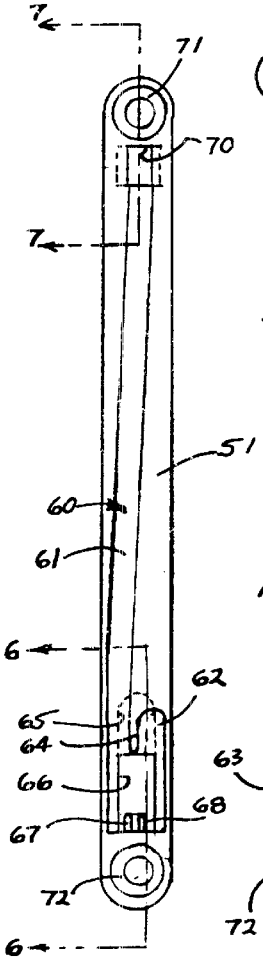
FIG. 5 is a view of the housing of the latching/guide mechanism.
Figure 7:
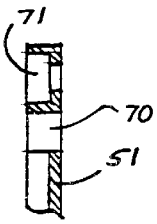
FIG. 7 is a cross-sectional view taken along the lines 7—7 of FIG. 5.
Figure 6:
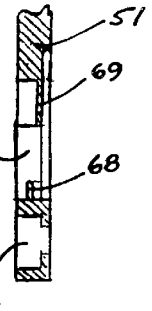
FIG. 6 is a cross-sectional view taken along the lines 6—6 of FIG. 5.

In the preferred embodiment, illustrated in FIGS. 5–7, latching/guide mechanism 50 will be seen to comprise an elongated housing 51 with a latching chamber 63 at the lower end and a longitudinally disposed guide channel 60. Housing 51 is essentially a solid component, made of either plastic or metal. It includes channel 60, of constant depth, extending from top to bottom. Section 61, of channel 60, extends longitudinally from one side of latching chamber 63, inclining slightly in order to attain a central position at the top of the housing. Section 62, of channel 60, lies adjacent the bottom of section 61, creating a top for the latching chamber 63 with a projecting partition 64 separating the two sections. The width of channel 60, in both sections, is selected to permit nesting and guidance of coupling element 31. Thus, for example, the head of coupling element 31 is illustrated in FIG. 4 by dashed outline.

Figure 8:
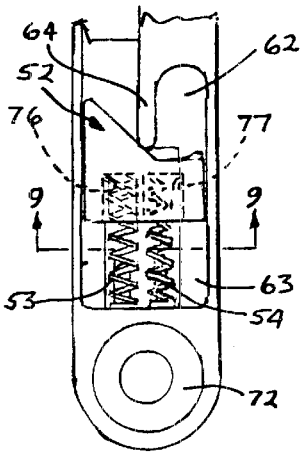
FIG. 8 is an enlarged view of the latching cavity of the latching/guide mechanism with the latching cam in the quiescent position.

Within latching chamber 63, housing 51 includes two short posts 67, 68 for mounting and guidance of springs 53, 54 (illustrated in FIG. 8 and to be described hereinafter). At the back of latching chamber 63, an aperture 66 extends up and beyond partition 64 to provide a retaining channel for the mounting tongue 78 of a latching cam 52 (illustrated in FIG. 10 and to be described hereinafter). In addition, at the upper end of channel 60, an aperture 70 is provided for convenience in mounting a bumper element. Shouldered cavities 71, 72 are advantageously furnished at the ends of housing 51, to accept fasteners 56, 51 for securing latching/guide mechanism 50 within side post 22.

Figure 10:
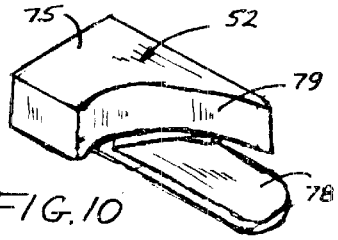
FIG. 10 is a perspective view of the latching cam, removed from the latching chamber of the latching/guide mechanism housing.
Figure 9:
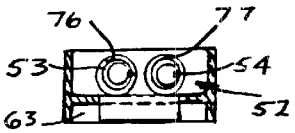
FIG. 9 is a cross-sectional view taken along the lines 9—9 in FIG. 8.

Latching cam 52 is a tongued element, adapted for mounting to move vertically within latching chamber 63. As shown in FIGS. 8–10, latching cam 52 comprises a body portion 75 having a camming surface 79 and a projecting tongue 78. Holes 76, 77 are provided in the end of the cam remote from the camming surface 79, to receive biasing springs 53, 54. Camming surface 79 bears upon and guides coupling element 31 between sections 61, 62 of channel 60 when an operator raises or lowers crib side 14.

Latching cam 52 is mounted within housing 51, with tongue 78 projecting through cavity 66 and along the extension 69 thereof. Springs 53, 54 are mounted upon pins 67, 68 and into cavities 76, 77 of latching cam 52. Thus, the cam is resiliently biased in an upward direction into contact with dividing partition 64 that separates sections 61 and 62 of channel 60. Latching cam 52 reacts to pressure from coupling element 31 on camming surface 79 to move downward against the bias of springs 53, 54, thereby permitting coupling element 31 to move from section to section of channel 60, under the control of an operator.

It should be appreciated that while carrying out latching and locking operations, the releasable side of the crib is moved, while the crib itself remains stationary. Thus, vertical and horizontal movements of the crib side in which latching/guide mechanism 50 is mounted, provide the initiating forces that cause interaction between stationary coupling element 31 and latching/guide mechanism 50.

The description of components has been directed to the coupling between the left edge of crib side 14 and crib end 11. A corresponding coupling will be provided between the right edge of crib side 14 and the opposite end 12 of the crib. It will be understood that this corresponding coupling includes a latching/guide mechanism that is substantially a mirror image of the one described.

Returning attention to FIG. 2, the top of crib side 14 is held in position and guided in travel, by coupling element 30 and guide element 40; the former being fastened to project from end post 17 and the latter being mounted flush within the surface of side post 22.

Figure 11:
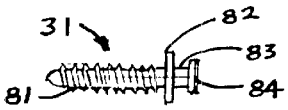
FIG. 11 illustrates a coupling element of the type that is advantageously used in a preferred embodiment of the invention.

As noted earlier, in this particular embodiment, coupling element 30 is identical to the coupling element 31, used to interact with latching/guide mechanism 50. It is shown in FIG. 11. The element comprises a threaded portion 81, a shoulder portion 82, and a head portion 84 separated from the shoulder by a shank portion 83. When acting in conjunction with latching/guide mechanism 50, head portion 84 travels within channel 60 and interacts also with latching cam 52 in latching chamber 63. When acting in conjunction with guide element 40, shank portion 83 constrains coupling element 30 to stay within particular track 42 while head portion 84 couples crib side 14 to crib end 17.

FIG. 12 shows guide element 40, mounted flush near the top and within the face of side post 22. It includes an elongated track 42 having a length substantially equal to that of section 61 of channel 60, in latching/guide mechanism 50. Track 42 encloses a cavity within side post 22 and has an opening throughout its length, slightly greater than the diameter of shank portion 83 of coupling element 30. A larger opening 43 is provided at the top of track 42, to permit passage into the cavity, of head 84 of coupling element 30. Thus, when side 14 is assembled to crib ends 11, 12 the upper portion of crib side 14 is constrained to move only vertically, while simultaneously acting as a brace holding the tops of ends 11, 12.

Return to FIGS. 3 and 4, and consider the interaction of coupling element 31 and latching/guide mechanism 50. Head 84 of coupling element 31 projects into channel 60 of latching/guide mechanism 50. Due to the force of gravity upon side 14, the lower tip of partition 64 is pressing against head 84. The cam surface of latching cam 52 is pressed upward into contact with head 84 under the action of the biasing springs 53, 54. This is only a transitory position and is not stable. Slight horizontal movement of post 22, i.e. side 14, will cause it: to move inwardly and drop slightly to trap coupling element 31 at the top of section 62, locking side 14 in a raised position; or to move outwardly sliding down with coupling element 31 in section 61 until it comes to rest in contact with bumper 55, leaving side 14 in a lowered position.

With an understanding of the crib structure and hardware, the operations of raising, lowering and locking releasable side 14 can be described. Refer to FIGS. 4 and 12. When the crib is assembled, guide element 40 and latching/guide mechanism 50 are vertically disposed at the top and bottom edges of crib side 14. Coupling elements 30, 31 are fastened to end post 17, spaced so that each falls within the same portion of the transit path through their respective guides 42, 61. For purpose of example, coupling element 30 is shown on phantom outline within track 42 of guide element 30 and coupling element 31 is shown in phantom outline within section 61 of latching/guide mechanism 50.

When crib side 14 is in its uppermost position, coupling elements 30 and 31 are disposed at the lowermost portions of guide element 40 and latching/guide mechanism 50. When crib side 14 is locked in the raised position, coupling element 31 is nested in latching chamber 63 at the top of section 62. It is held in this position by the weight of crib side 14. To lower crib side 14, the operator first pulls it upward slightly, while simultaneously pulling the bottom outward (post 22 moves to the right as viewed in FIG. 4). This forces coupling element 31 down against camming surface 79 of cam 52, around and past the point of partition 64, and into section 61 of channel 60. As crib side 14 is lowered, coupling element 31 guides it along section 61 until stopped when it contacts bumper 55. Crib side 14 is now down.

To raise side 14 and lock it in its uppermost position, the operator simply pulls it upward, causing the side to rise within section 61 guided by coupling element 31 until it comes into contact with camming surface 79 of latching cam 52. Due to the contour of surface 79, as upward motion continues the side is pressed inwardly (post 22 moves to the left as viewed in FIG. 4) and coupling element 31 traverses surface 79 of latching cam 52 to its lower end where it is free to move up into section 62 of channel 60 as the operator releases crib side 14. Crib side 14 has now been raised and locked in its uppermost position.

A particular embodiment of the invention has been shown and described. The invention relates to a combination of components and their interrelationship to one another. It also relates specifically to the structure and operation of crib hardware. It will be apparent to those skilled in the art that the unique hardware of the invention can be fabricated of numerous materials and furthermore that the structure of the components may be modified. In so far as such modifications come within the spirit of the invention, they are contemplated by the inventor and are intended to come within the scope of the following claims.

What is claimed is:

1. Crib hardware for mounting a releasable crib side having an elongated edge adjacent to a stationary crib end, including an elongated latching/guide unit having a substantially flat surface for mounting flush within said edge, a longitudinally disposed guide channel in said surface extending along said unit, and coupling means for mounting on said crib end projecting into said guide channel; said hardware comprising a latching chamber at one end of said guide channel; a locking channel within said latching chamber; latching means in said latching chamber operative responsive to relative movement between said latching/guide unit and said coupling means a) when said coupling means is in said guide channel to direct said coupling means into said locking channel, and b) when said coupling means is in said locking channel to direct said coupling means into said guide channel.

2. Crib hardware as defined in claim 1, wherein said latching chamber is laterally centered on said latching/guide unit and the end of said guide channel remote from said latching chamber is laterally centered on said latching/guide unit.

3. Crib hardware as defined in claim 2, including shock absorbing means on the end of said longitudinally disposed channel remote from said one end containing said latching chamber.

4. Crib hardware as defined in claim 1, wherein said latching chamber includes a partition separating said guide channel from said locking channel with a connecting passage therebetween, said latching means comprising cam means with an inclined surface for contact with said coupling means, said cam means being resiliently biased to block said passage in its quiescent condition and being operative to open said passage when depressed by pressure from said coupling means, whereby said coupling means is released from said locking channel by effecting relative movement of said latching/guide unit and said coupling means in opposing directions and applying lateral pressure on said latching/guide unit toward the locking channel.

5. Crib hardware as defined in claim 1, including in combination a second elongated guide unit having a substantially flat surface for mounting flush within said edge; a longitudinally disposed retaining channel within the surface of said second guide unit; second coupling means for mounting on said crib end projecting into said retaining channel, said retaining channel including means for preventing withdrawal of said second coupling means.

6. Crib hardware for mounting a releasable crib side having an elongated edge facing an adjacent crib end, including: an elongated latching/guide unit having a substantially flat surface for mounting flush within said edge, a longitudinally disposed guide channel within said surface extending along said unit, and coupling means for mounting on said crib end projecting into said guide channel; said hardware comprising: a latching chamber at one end of said guide channel; a locking channel within said latching chamber disposed parallel to said guide channel; a partition in said latching chamber separating said guide channel from said locking channel with a connecting passage therebetween; cam means with an inclined surface for contact with said coupling means, said cam means being resiliently biased to block said passage in its quiescent condition and being operative to open said passage when depressed by pressure from said coupling means, whereby said coupling means is released from said locking channel by effecting relative movement of said latching/guide unit and said coupling means in opposing directions and applying lateral pressure on said latching/guide unit toward the locking channel.

7. Crib hardware as defined in claim 6, wherein said latching chamber is laterally centered on said latching/guide unit and the end of said guide channel remote from said latching chamber is laterally centered on said latching/guide unit.

8. Crib hardware as defined in claim 7, including shock absorbing means on the end of said longitudinally disposed channel remote from the end containing said latching chamber.

9. Crib hardware as defined in claim 6, including in combination a second elongated guide unit having a substantially flat surface for mounting flush within said edge; a longitudinally disposed retaining channel within the surface of said second guide unit; second coupling means for mounting on said crib end projecting into said retaining channel; said retaining channel including means for preventing withdrawal of said second coupling means.

* * * * *